US008550313B2

(12) United States Patent
Daggett

(10) Patent No.: US 8,550,313 B2
(45) Date of Patent: Oct. 8, 2013

(54) SIFT-RESISTANT DISPENSING CLOSURE

(75) Inventor: Barry Michael Daggett, Austintown, OH (US)

(73) Assignee: Weatherchem Corporation, Twinsburg, OH (US)

( * ) Notice: Subject to any disclaimer, the term of this patent is extended or adjusted under 35 U.S.C. 154(b) by 1126 days.

(21) Appl. No.: 12/382,270

(22) Filed: Mar. 12, 2009

(65) Prior Publication Data

US 2010/0230446 A1 Sep. 16, 2010

(51) Int. Cl.
*B67D 3/00* (2006.01)

(52) U.S. Cl.
USPC ..... 222/480; 222/556; 222/565; 220/254.2; 220/254.3; 215/235

(58) Field of Classification Search
USPC ..... 222/556, 565, 4, 81, 480, 51, 7, 498, 222/545–546; 220/259.3, 254.1, 837, 254.2, 220/287, 254.3, 259.2, 254.7, 259.1; 215/235–237
See application file for complete search history.

(56) References Cited

U.S. PATENT DOCUMENTS 3,160,327 A 12/1964 Porcelli
3,351,242 A 11/1967 Lodding et al.
3,629,901 A 12/1971 Wolf et al.
4,284,200 A * 8/1981 Bush et al. ..... 215/215
4,359,171 A 11/1982 Lewis
4,361,250 A 11/1982 Foster et al.
4,369,901 A * 1/1983 Hidding ..... 222/480
4,403,712 A 9/1983 Wiesinger et al.
4,454,958 A 6/1984 Juillet et al.
4,457,458 A 7/1984 Heinol et al.
4,610,371 A * 9/1986 Karkiewicz ..... 220/266
4,611,725 A 9/1986 Kacalieff et al.
4,693,399 A 9/1987 Hickman et al.
4,723,693 A * 2/1988 DeCoster ..... 222/483
4,881,668 A * 11/1989 Kitterman et al. ..... 222/482
4,915,268 A 4/1990 Lay et al.
4,936,494 A 6/1990 Weidman
5,040,695 A 8/1991 Adams et al.
5,219,100 A * 6/1993 Beck et al. ..... 222/480
5,330,082 A 7/1994 Forsyth
5,509,582 A 4/1996 Robbins et al.
5,540,343 A 7/1996 Schumacher et al.
5,762,199 A 6/1998 Aguilera et al.
5,913,435 A 6/1999 Fuchs et al.

(Continued)

OTHER PUBLICATIONS

OA dated Sep. 16, 2011 for U.S. Appl. No. 12/314,368, 17 pages.

(Continued)

*Primary Examiner* — Frederick C Nicolas
(74) *Attorney, Agent, or Firm* — Turocy & Watson, LLP

(57) ABSTRACT

A sift-resistant dispensing closure is disclosed. The sift-resistant dispensing closure includes a base, a lid and a hinge connecting the lid to the base. The base contains a circular end wall, a cylindrical skirt extending downward from the periphery of the end wall, and a sift deck elevated from the upside of the circular end wall. The sift deck contains a deck surface surrounded by a first snap bead and a first sealing surface, and pouring holes formed on the deck surface. The lid contains a second snap bead and a second sealing surface that are formed on the underside of the lid and engage with the first snap bead and first sealing surface, respectively, to form a seal around the sift deck when the lid is in a closed position.

17 Claims, 4 Drawing Sheets

(56) References Cited

U.S. PATENT DOCUMENTS

| | | | | |
|---|---|---|---|---|
| 5,927,535 | A | 7/1999 | Goth et al. | |
| 5,938,068 | A | 8/1999 | Atkins et al. | |
| 5,975,368 | A * | 11/1999 | Wood | 222/151 |
| 6,050,434 | A | 4/2000 | McNab | |
| 6,116,477 | A * | 9/2000 | Kreiseder et al. | 222/556 |
| 6,286,731 | B1 * | 9/2001 | Lillelund et al. | 222/480 |
| 6,321,923 | B1 | 11/2001 | Wood et al. | |
| 6,355,335 | B1 | 3/2002 | Kulkaski et al. | |
| 6,364,169 | B1 | 4/2002 | Knickerbocker | |
| 6,439,410 | B1 | 8/2002 | Dubach et al. | |
| 6,575,323 | B1 * | 6/2003 | Martin et al. | 220/254.3 |
| 7,121,438 | B2 * | 10/2006 | Hoepner et al. | 222/544 |
| 7,134,575 | B2 * | 11/2006 | Vogel et al. | 222/143 |
| 7,258,255 | B2 | 8/2007 | Vogel et al. | |
| 7,322,493 | B2 | 1/2008 | Skillin et al. | |
| D618,063 | S | 6/2010 | Davies et al. | |
| 7,913,868 | B2 * | 3/2011 | Dolan et al. | 220/254.2 |
| 8,066,158 | B2 * | 11/2011 | Vogel et al. | 222/480 |
| 2004/0111836 | A1 | 6/2004 | Lagler et al. | |
| 2006/0011667 | A1 | 1/2006 | Skillin et al. | |
| 2007/0170192 | A1 | 7/2007 | Blum et al. | |
| 2007/0283529 | A1 | 12/2007 | Hashizume et al. | |
| 2008/0110942 | A1 | 5/2008 | Blomdahl et al. | |
| 2008/0257918 | A1 * | 10/2008 | Vogel et al. | 222/480 |
| 2010/0140304 | A1 * | 6/2010 | Walunis et al. | 222/480 |
| 2010/0224643 | A1 | 9/2010 | Daggett et al. | |

OTHER PUBLICATIONS

OA dated Apr. 19, 2012 for U.S. Appl. No. 12/314,368, 14 pages.
OA dated May 20, 2011 for U.S. Appl. No. 12/379,872, 18 pages.
OA dated Oct. 17, 2011 for U.S. Appl. No. 12/379,872, 15 pages.
OA dated Sep. 24, 2012 for U.S. Appl. No. 12/379,872, 17 pages.
OA dated Nov. 23, 2012 for U.S. Appl. No. 12/314,368, 22 pages.
Non-Final Office Action dated Mar. 26, 2013 for U.S. Appl. No. 12/314,368, 21 pages.
Final Office Action dated Apr. 12, 2013 for U.S. Appl. No. 12/379,872, 20 pages.
Canadian Office Action dated Apr. 12, 2013 for Canadian Patent Application No. 2,701,019, 3 pages.

* cited by examiner

SIFT-RESISTANT DISPENSING CLOSURE

FIELD OF THE INVENTION

The invention generally relates to dispensing closures and, in particular, to a sift-resistant dispensing closure.

BACKGROUND

There is a constant need for product containment in the spice and seasoning markets. Usually this containment is accomplished by a sealed liner between the container and the container closure that prevents leakage of the content during shipment and storage. However, after an end user removes the sealed liner, the container is no longer tightly sealed and is prone to sift. For example, the product will often spill or leak if the container falls on its side. Such a spill can create a bad experience for the consumer and eventually affect sales of the product. In addition, there is a need for the packaging industry to lower production costs and eliminate the sealed liner. Another ongoing issue with dispensing closures in the marketplace is product build-up on the deck of the closure. Over time the build-up may interfere with the closure of the container, thus affecting product freshness and worsening the spill problem. Therefore, there exists a constant need for better dispensing closures that are resistant to sift and product built-up, and can be produced at low cost.

SUMMARY OF THE INVENTION

A sift-resistant dispensing closure is disclosed. The sift-resistant dispensing closure includes a base, a lid and a hinge connecting the lid to the base. The base includes an end wall, a skirt extending downward from the periphery of the end wall, and a sift deck elevated from the upside of the end wall. The sift deck has a deck surface surrounded by a first sealing means and pouring holes formed on the deck surface. The lid has a second sealing means formed on the underside of the lid. The second sealing means engages with the first sealing means on the sift deck to form a seal around the sift deck when the lid is in a closed position.

Another embodiment of the sift-resistant dispensing closure includes a base, a lid and a hinge connecting the lid to the base. The base includes a circular end wall, a cylindrical skirt extending downward from the periphery of the end wall, and a sift deck elevated from the upside of the circular end wall. The sift deck has a concave deck surface surrounded by a first snap bead and a first sealing surface, and pouring holes formed on the concave deck surface. The lid has a second snap bead and a second sealing surface. The second snap bead and second sealing surface are formed on the underside of the lid and engage with the first snap bead and first sealing surface, respectively, to form a seal around the sift deck when the lid is in a closed position.

Also disclosed is a container assembly having a container with an opening; and a sift-resistant dispensing closure attached to the opening. The sift-resistant dispensing closure includes a base, a lid and a hinge connecting the lid to the base. The base includes an end wall, a skirt extending downward from the periphery of the end wall, and a sift deck elevated from the upside of the end wall. The sift deck has a deck surface surrounded by a first sealing means and pouring holes formed on the deck surface. The lid has a second sealing means formed on the underside of the lid. The second sealing means engages with the first sealing means on the sift deck to form a seal around the sift deck when the lid is in a closed position.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
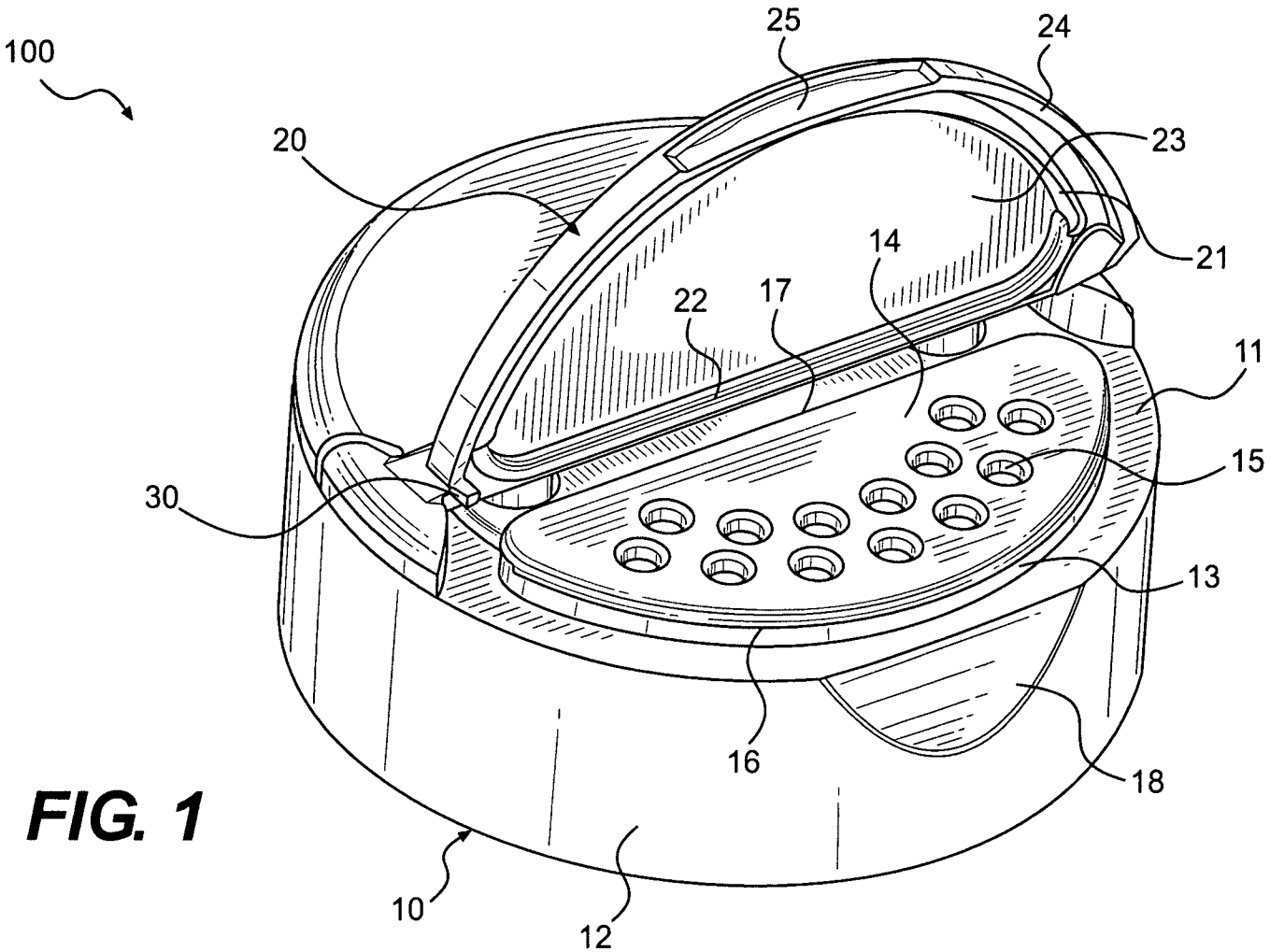
FIG. 1 is a perspective view of an embodiment of the sift-resistant dispensing closure.

This description is intended to be read in connection with the accompanying drawings, which are to be considered part of the entire written description of this invention. The drawings are not necessarily to scale and certain features of the invention may be shown exaggerated in scale or in somewhat schematic form in the interest of clarity. In the description, relative terms such as "front," "back," "up," "down," "top" and "bottom," as well as derivatives thereof, should be construed to refer to the orientation as then described or as shown in the drawing under discussion. These relative terms are for convenience of description, and normally are not intended to require a particular orientation. Terms concerning attachments, coupling and the like, such as "connected" and "attached," refer to a relationship wherein structures are secured or attached to one another either directly or indirectly through intervening structures, as well as both movable or rigid attachments or relationships, unless expressly described otherwise.

A sift-resistant dispensing closure is disclosed. The sift-resistant dispensing closure comprises a base, a lid and a hinge connecting the lid to said base. The base includes an end wall, a skirt extending downward from the periphery of the end wall; and a sift deck elevated from the upside of the end wall. The sift deck includes a deck surface surrounded by a first sealing means and pouring holes formed on the deck surface. The lid includes a second sealing means formed on the underside of the lid. When the lid is in a closed position, the second sealing means engages with the first sealing means on the sift deck to form a seal around the sift deck.

Figure 2:
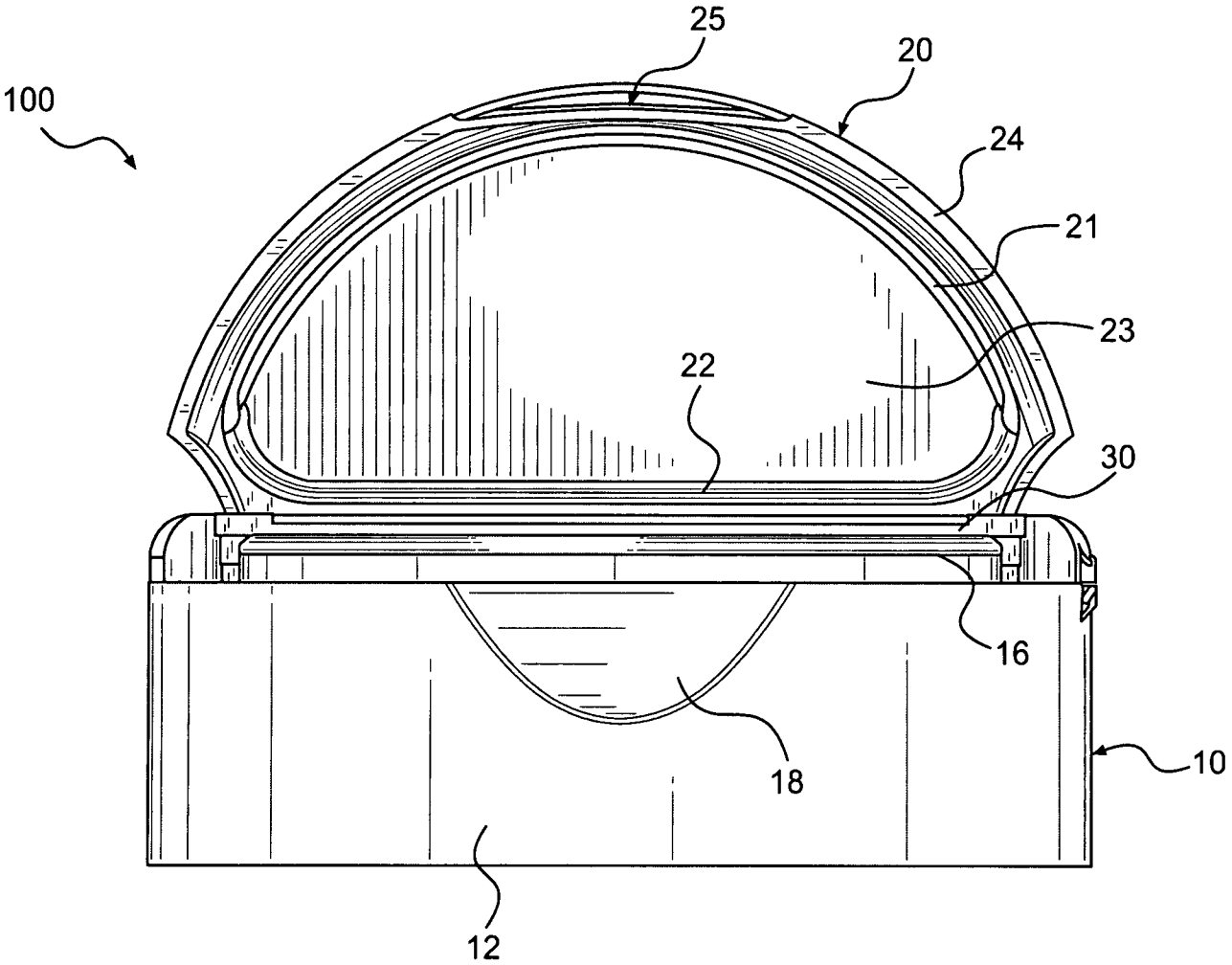
FIG. 2 is a side view of the sift-resistant dispensing closure of FIG. 1 in an open position.
Figure 3:
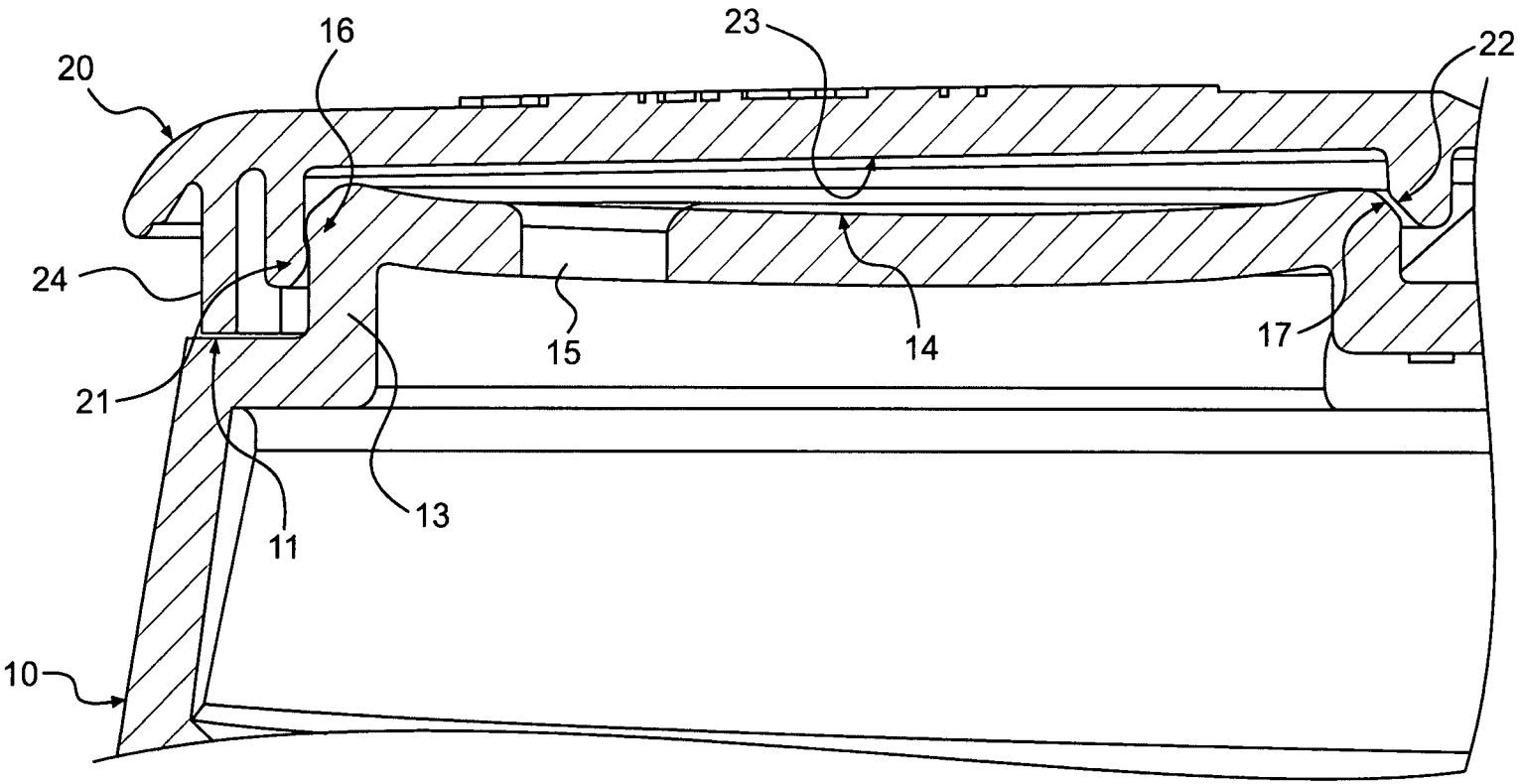
FIG. 3 is a cross-sectional view of the sift-resistant dispensing closure of FIG. 1 in a closed position.
Figure 4:
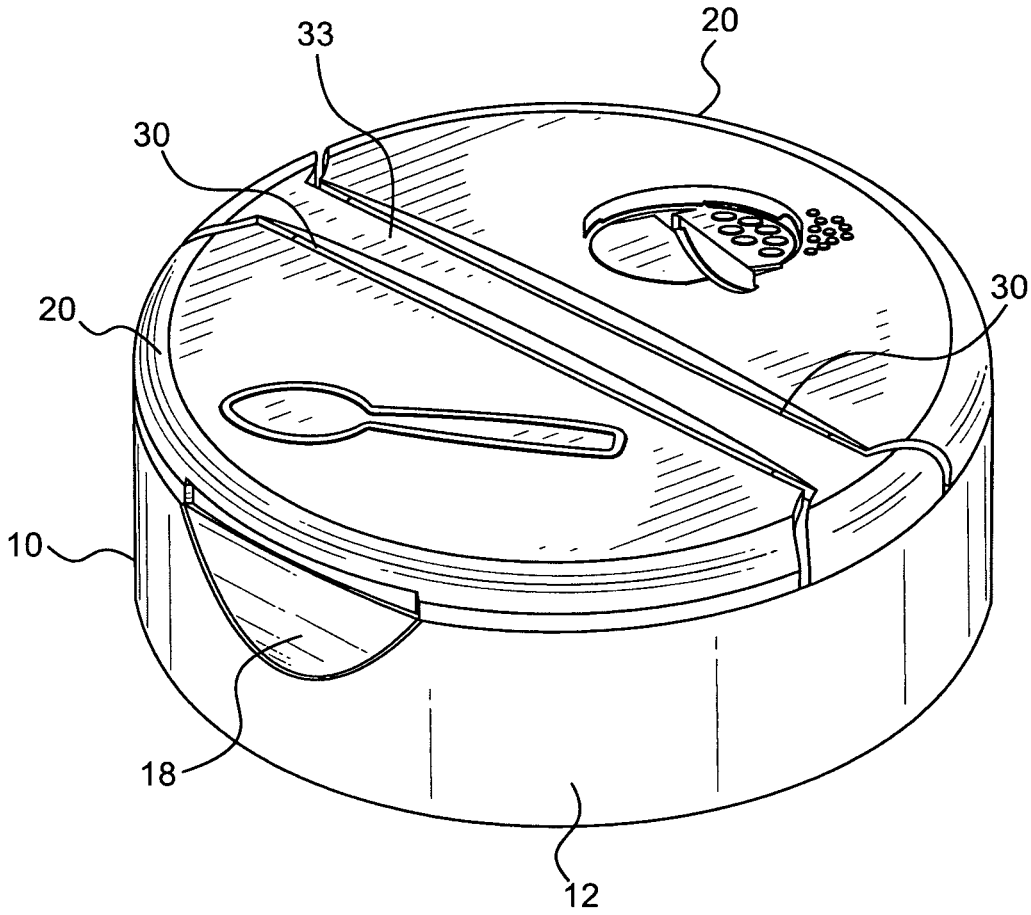
FIG. 4 is a perspective view of a sift-resistant dispensing closure with two lids.

Referring now to FIGS. 1-3, there is shown an embodiment of a sift-resistant dispensing closure 100. The sift-resistant dispensing closure 100 includes a base 10, a lid 20 and a hinge 30 connecting the lid 20 to the base 10. The base 10 has a generally circular end wall 11 and a cylindrical skirt 12 extending downward from the periphery of the end wall 11. The skirt 12 can be joined to a container either in a unitary manner or by other removable or non-removable means such as threading engagement, snap-on engagement, bonding by means of adhesive or welding, etc. In one embodiment, the skirt 12 is formed with internal threads enabling it to be screwed onto a mouth of a container. In another embodiment, the underside of the end wall 11 includes a circumferentially continuous sealing surface that registers with and can engage the mouth of a bottle or container.

A sift-resistant deck 13 is formed on the upside of the end wall 11. The sift-resistant deck 13 is elevated from the upper surface of the end wall 11 and has a concave deck surface 14 with one or more pouring openings 15. The size and shape of the pouring openings 15 may vary depending upon the type of contents to be dispensed from the container and upon the dispensing action that is desired. The concave deck surface 14 allows the leftover product on the deck surface to fall back into the container after each use and therefore prevents product built-up on the sift-resistant deck 13. The sift-resistant deck 13 is surrounded by a deck snap-bead 16 formed along the edge of the deck surface 14 and a sift deck sealing surface 17 formed in parallel to the hinge 30. As described in more detail below, the deck snap-bead 16 and deck sealing surface 17 interact with the corresponding structures on the lid 20 to form a tight seal around the sift-resistant deck 13 when the lid 20 is in a closed position.

The lid 20 opens and closes the pouring openings 15. A releasable lid catch mechanism, such as the snap bead design as illustrated, is provided to releasably hold the lid 20 closed on the end wall 21 and seal the sift deck 13. The snap bead catch structure on the lid 20 includes a complimentary lid snap bead 21 and a lid sealing surface 22. Both the lid snap bead 21 and the lid sealing surface 22 are protrusions formed on the inside surface 23 of the lid 20, with shapes and lengths that match those of the corresponding structures on the base 10 (i.e., the deck snap-bead 16 and deck sealing surface 17, respectively). As shown in FIG. 3, the lid snap-bead 21 engages with the deck snap bead 16 when the lid 20 is in a closed position and hold the lid 20 in the closed position. The engagement of the snap-beads 21 and 16 also pulls the lid sealing surface 22 and the deck sealing surface 17 against each other to form a complete seal around the sift-resistant deck 13, therefore preventing the contained product from escaping the closure 100. The engagement of the snap beads 16 and 21 also serves as a lid-to-base locking mechanism to prevent inadvertent opening of the lid 20. In one embodiment, the lid 20 further contains a lid skirt 24 extending downward from the periphery of the inside surface 23 of the lid 20. When the lid 20 is in a closed position, the lid skirt 24 is brought into contact with the upside of the end wall 11 in areas surrounding the sift deck 13, therefore forming a second seal around the sift deck 13.

In one embodiment, a thumbtab 18 is formed on the cylindrical skirt 12 on the side opposite to the living hinge 30 and a corresponding recession 25 is formed on the lid 20 to facilitate the opening of the lid 20.

In another embodiment, the sift deck 13 is surrounded by a circular guard wall and the lid catch mechanism includes an edge protruding from the exterior of the guard wall and a complimentary curvature on the inside surface 23 of the lid 20.

Although a D-shaped sift deck is shown in the drawings, a person of ordinary skill in the art would understand that the size and shape of the sift deck 13 is application dependent, and that the snap bead and sealing surfaces on the base 10 and lid 20 can be adjusted accordingly to provide a complete seal around the sift deck 13.

The hinge 30 is preferably a living hinge. As used hereinafter, the term "living hinge" refers to a hinge integrally formed with two opposite portions of the same material. Typically the material along the living hinge is thin relative to the adjacent areas to facilitate flexing or bending of the opposite portions (e.g., the base 10 and lid 20). A living hinge allows one portion (e.g., the lid 20) to bend relative to the other portion (e.g., the base 10), as would other hinges between the two portions. A living hinge allows for a single piece design that can be molded as in-line of draw. No slides or sub-slides are required in the molding design.

In one embodiment, the dispensing closure 100 contains a pair of lids 20. Each of the lids 20 selectively opens and closes a pouring opening and shake openings, respectively. The lids 20 are connected to a chordal or diametral area 33 by respective living hinges 30. The term "chordal", as used herein, is intended to cover the special case where the area 33 is symmetrical with a diametral line such as where, as illustrated, the lids 20 are essentially of the same size, but also includes arrangements where the lids are of unequal size and the area is more distinctly offset from a true diametral line. The lids 20 may optionally contain signs or symbols showing the type of openings that the lids 20 cover. For example, the lid that covers a pouring or spooning opening may contain a spoon symbol and the lid that covers shaking openings may have a symbol for shaking openings on top of the lid. In the illustrated case, the living hinges 30 are elongated elements that extend along a major portion of the chordal area 33 and the width of the respective lids. The living hinges 30 in the illustrated embodiment are parallel to each other. The hinges 30 comprise relatively thin, small areas of material that connect the lids 20 to the chordal area 33.

The sift-resistant dispensing closure 100 allows for the elimination of a sealed liner between the container and the dispense closure 100. The sift-resistant dispensing closure 100 can also be produced as a single piece in a molding process and thus lower the production cost.

Also disclosed is a container assembly. The container assembly includes a container having a dispensing opening and a sift-resistant dispensing closure attached to the dispensing opening. The sift-resistant dispensing closure includes a base, a lid and a hinge connecting said lid to said base. The base includes an end wall, a skirt extending downward from the periphery of the end wall, and a sift deck elevated from the upside of the end wall. The sift deck has a deck surface and pouring holes formed on the deck surface. The sift deck is surrounded by a first snap-bead and a first sealing surface. The lid contains a second snap bead and a second sealing surface that are formed on the underside of the lid. When the lid is in a closed position, the second snap bead and second sealing surface engage with the first snap bead and first sealing surface on the base, respectively, to form a seal around the sift deck.

In one embodiment, the dispensing closure is reversibly attached to the container. In another embodiment, the dispensing closure is irreversibly attached to the container.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A sift-resistant dispensing closure, comprising:

a base comprising:

an end wall;

a skirt extending downward from a periphery of the end wall;

a sift deck elevated from an upside of the end wall, the sift deck comprising a deck surface surrounded by a first sealing means formed along an edge of the deck surface, and pouring holes formed on the deck surface;

a lid comprising a second sealing means formed on an underside of the lid;

another sift deck; and another lid capable of sealing the another sift deck; and a hinge connecting the lid to the base, wherein the second sealing means engages with the first sealing means on the sift deck to form a seal around the sift deck when the lid is in a closed position.

2. The sift-resistant dispensing closure of claim 1, wherein the first sealing means comprises a first snap bead and a first sealing surface, and wherein the second sealing means comprises a second snap bead and a second sealing surface that engage with the first snap bead and the first sealing surface, respectively, to form the seal around the sift deck when the lid is in the closed position.

3. The sift-resistant dispensing closure of claim 2, wherein the deck surface is a concave deck surface.

4. The sift-resistant dispensing closure of claim 1, wherein the hinge is a living hinge.

5. The sift-resistant dispensing closure of claim 4, wherein the end wall is a circular end wall and the skirt is a cylindrical skirt with internal threads.

6. The sift-resistant dispensing closure of claim 1, wherein the skirt further comprises a thumbtab.

7. A sift-resistant dispensing closure, comprising a base comprising:

a circular end wall;

a cylindrical skirt extending downward from a periphery of the circular end wall; and a sift deck elevated from an upside of the circular end wall, the sift deck comprising a concave deck surface surrounded by a first snap bead formed at an edge of the concave deck surface and a first sealing surface, and pouring holes formed on the concave deck surface;

another sift deck; and another lid capable of sealing the another sift deck; and a lid comprising:

a second snap bead; and a second sealing surface, wherein the second snap bead and the second sealing surface are formed on an underside of the lid and engage with the first snap bead and the first sealing surface, respectively, to form a seal around the sift deck when the lid is in a closed position; and a hinge connecting the lid to the base.

8. The sift-resistant dispensing closure of claim 7, wherein the hinge is a living hinge.

9. The sift-resistant dispensing closure of claim 7, wherein the cylindrical skirt comprises internal threads.

10. The sift-resistant dispensing closure of claim 7, wherein cylindrical skirt further comprises a thumbtab.

11. The sift-resistant dispensing closure of claim 7, wherein the sift deck comprises a D-shaped concave deck surface with the first snap bead formed along a curved edge of the concave deck surface and the first sealing surface formed along a straight edge of the concave deck surface.

12. A container assembly, comprising:

a container with an opening; and a sift-resistant dispensing closure attached to the opening, the sift-resistant dispensing closure comprises:

a base comprising an end wall, a skirt extending downward from a periphery of the end wall, and a sift deck elevated from an upside of the end wall, the sift deck comprising a deck surface surrounded by a first sealing means formed at an edge of the deck surface, and pouring holes formed on the deck surface, another sift-deck, and another lid capable of sealing the another sift-deck;

a lid comprising a second sealing means formed on a underside of the lid;

and a hinge connecting the lid to the base, wherein the second sealing means engages with the first sealing means on the sift deck to form a seal around the sift deck when the lid is in a closed position and wherein the first sealing means does not extend higher than the deck surface.

13. The container assembly of claim 12, wherein the first sealing means comprises a first snap bead formed along the deck surface and a first sealing surface formed parallel to the hinge, and wherein the second sealing means comprises a second snap bead and a second sealing surface that engage with the first snap bead and the first sealing surface, respectively, to form the seal around the sift deck when the lid is in the closed position.

14. The container assembly of claim 12, wherein the hinge is a living hinge.

15. The container assembly of claim 12, wherein the end wall is a circular end wall and the skirt is a cylindrical skirt comprising internal threads.

16. The container assembly of claim 12, wherein the skirt further comprises a thumbtab.

17. The sift-resistant dispensing closure of claim 12, wherein the deck surface is a concave deck surface.

* * * * *